US005169140A

United States Patent [19]

Wenthe, Jr.

[11] Patent Number: 5,169,140

[45] Date of Patent: Dec. 8, 1992

[54] METHOD AND APPARATUS FOR DESKEWING AND SIDE REGISTERING A SHEET

[75] Inventor: Stephen J. Wenthe, Jr., West Henrietta, N.Y.

[73] Assignee: Xerox Corporation, Stamford, Conn.

[21] Appl. No.: 796,955

[22] Filed: Nov. 25, 1991

[51] Int. Cl.[5] ..... B65H 7/02

[52] U.S. Cl. ..... 271/228; 271/227; 271/250

[58] Field of Search ..... 271/228, 248, 250, 252, 271/227

[56] References Cited

U.S. PATENT DOCUMENTS

| | | | |
|---|---|---|---|
| 1,951,901 | 3/1934 | Cottrell, 3rd. | 271/53 |
| 2,407,174 | 9/1946 | Oberender . | |
| 3,131,931 | 5/1964 | Fechkowsky | 271/48 |
| 3,240,487 | 3/1966 | Templeton | 271/53 |
| 3,360,262 | 12/1967 | Kekopoulos et al. | 271/63 |
| 3,368,726 | 2/1968 | Funk et al. | 226/17 |
| 3,525,872 | 8/1970 | Schneider | 250/219 |
| 3,603,446 | 9/1971 | Maxey et al. | 198/33 |
| 3,758,104 | 9/1973 | Daily | 271/75 |
| 3,883,134 | 5/1975 | Shinaki | 271/261 |
| 3,897,945 | 8/1975 | Faltot et al. | 271/227 |
| 4,082,456 | 4/1978 | Schröter | 355/109 |
| 4,155,440 | 5/1979 | Bogdanski et al. | 198/399 |
| 4,216,482 | 8/1980 | Mason | 346/129 |
| 4,438,917 | 3/1984 | Janssen et al. | 271/227 |
| 4,475,156 | 10/1985 | Federico | 364/300 |
| 4,500,086 | 2/1985 | Garavuso | 271/225 |
| 4,511,242 | 4/1985 | Ashbee et al. | 355/14 C |
| 4,519,700 | 5/1985 | Barker et al. | 355/3 SH |
| 4,971,304 | 11/1990 | Lofthus | 271/227 |
| 5,078,384 | 1/1992 | Moore | 271/228 |

FOREIGN PATENT DOCUMENTS

| | | | |
|---|---|---|---|
| 1028495 | 4/1958 | Fed. Rep. of Germany . | |
| 5220562 | 2/1975 | Japan . | |
| 54-149175 | 11/1979 | Japan . | |
| 0066050 | 3/1988 | Japan | 271/259 |

OTHER PUBLICATIONS

"Means to Correct Document Skew"; Research Disclosure, Nov., 1979, pp. 642-643, No. 18759.

*Primary Examiner*—H. Grant Skaggs
*Assistant Examiner*—Carol Lynn Druzbeck
*Attorney, Agent, or Firm*—Paul J. Maginot

[57] ABSTRACT

A method of deskewing and side registering a sheet is disclosed. The method includes the step of driving a sheet non-differentially in a process direction with a sheet driver, the sheet having an unknown magnitude of side-to-side misregistration and an unknown initial angle of skew. The method further includes the steps of measuring the initial angle of skew with an initial skew sensing mechanism and driving the sheet differentially with the sheet driver to compensate for the magnitude of side-to-side misregistration and thereby induce a registration angle of skew. Moreover, the method includes the steps of measuring the registration angle of skew with a registration skew sensing mechanism and summing the initial angle of skew and the registration angle of skew so as to determine an absolute angle of skew. The method additionally includes the step of driving the sheet differentially with the sheet driver to compensate for the absolute angle of skew so that the sheet is deskewed and one edge of the sheet is side registered. Also disclosed is an apparatus for deskewing and side registering a sheet having an unknown magnitude of side-to-side misregistration and an unknown initial angle of skew.

20 Claims, 4 Drawing Sheets

METHOD AND APPARATUS FOR DESKEWING AND SIDE REGISTERING A SHEET

This invention relates generally to paper handling devices, and more particularly concerns a method and apparatus for deskewing and side registering a sheet which is moving in a process direction.

Xerographic reproduction machines utilize paper handling devices and usually incorporate a registration system to properly align sheets of paper passing through these devices. Whether the sheet is a document in a recirculating document handler or a copy sheet in a reproduction processor, registration and alignment of sheets traveling through a sheet path is important for the achievement of high quality copying.

Passive alignment systems have heretofore existed which make use of physical contact with the sheet for alignment generally by providing a fixed position contacting registration member at an appropriate position for a selected registration operation. Such contacting members include gripper bars, side guides, tamper arrangements, stalled rolls and registration fingers. A common problem of the above devices is caused by the inherent relative motion between the registration member and the sheet during contact. Contact and slippage between the registration member and sheet can cause unacceptable damage to the sheet edge, and potential jamming of the machine. Additionally, long term contact between passing sheets and the registration member may cause wear of the registration member, leading to long term variance in registration accuracy. The above devices also may require undesirably long sheet paths to be effective.

Also known is the use of active driving arrangements to alter the orientation of objects such as a sheet of paper, cardboard or cloth, by providing differentially driven driving members, as exemplified by U.S. Pat. Nos. 2,407,174 to Oberender; 3,758,104 to Dailey; 4,155,440 to Bogdanski et al.; 3,131,931 to Fechkowsky; 3,240,487 to Templeton; 3,897,945 to Faltot et al.; 4,082,456 to Schröter; 4,500,086 to Garavuso; "Means to Correct Document Skew," Research Disclosure, Nov. 1979, pp. 642-643, No. 18759 and; West German Pat. No. 1,028,495. Some positive driving arrangements are provided with sensors to sense position of the objects, to deskew or position the objects, such as U.S. Pat. Nos. 3,525,872 to Schneider; 4,082,456 to Schröter; 3,360,262 to Kekopoulos e al.; Japanese Kokai 54-149175 and Japanese Kokai 52-20562, which disclose detection of lead edge skew, and U.S. Pat. Nos. 1,951,901 to Cottrel, 3d; 3,368,726 to Funk et al.; 3,603,446 to Maxey et al.; and 3,883,134 to Shinaki which teach detection of side edge registration.

Certain registration systems provide active registration devices which sense document position and operate to correct the positioning, if necessary. With particular reference to U.S. Pat. No. 4,438,917 to Janssen et al., a sheet deskewing arrangement may be provided with a sensor set arranged along the path of sheets in the processing direction and a pair of selectably controllable motors, each driving a driving nip in a nip roll pair, supported to contact a side portion of the sheet in driving engagement, to correct skew sensed by the sensors. The two sensors, arranged in a line perpendicular to the path of sheet travel, each detect when the lead edge of a sheet passes thereby. A difference in sensing time of sheet passage by each sensor is indicative of sheet skew, and the two motors are driven in accordance with the difference to accelerate or decelerate a side portion of the sheet, thereby rotating the sheet to bring the lead edge of the sheet into registration. This arrangement provides satisfactory registration, when paper is fed to the deskewing area with an induced initial skew angle, within a predetermined range of angles and in an appropriate direction. Additionally, this type of arrangement is attractive from the point of view that misregistration or misfunctioning of the registration apparatus results only in a misregistered copy, and does not damage the sheet or machine. U.S. Pat. No. 4,216,482 to Mason, describes a combination of a hard stopping pivot member and a positive driving arrangement, coupled with fixed and movable sensors to register a sheet. Moreover, U.S. Pat. No. 4,511,242 to Ashbee et al. discloses an electronic alignment mechanism for a paper processing machine and U.S. Pat. No. 4,519,700 to Barker et al. describes an electronically gated paper aligner system and U.S. Pat. No. 4,971,304 to Lofthus discloses an apparatus and method for deskewing and side registering a sheet.

It is accordingly an object of the present invention to provide a sheet registration arrangement for deskewing and side registration of sheets along a sheet conveyor.

It is another object of the present invention to provide a sheet deskewing and side registration arrangement that is useful in registration of sheets having an unknown magnitude of side-to-side misregistration and an unknown initial angle of skew.

It is yet another object of the present invention to provide a sheet registration arrangement which deskews and side registers a sheet in a relatively quick and efficient manner.

In accordance with one object of the present invention, there is provided a method of deskewing and side registering a sheet. The method includes the step of driving a sheet non-differentially in a process direction D with a sheet driver, the sheet having an unknown magnitude of side-to-side misregistration $\beta$ and an unknown initial angle of skew $\alpha$. The method further includes the steps of measuring the initial angle of skew $\alpha$ with an initial skew sensing mechanism and driving the sheet differentially with the sheet driver to compensate for the magnitude of side-to-side misregistration $\beta$ and thereby induce a registration angle of skew $\gamma$. Moreover, the method includes the steps of measuring the registration angle of skew $\gamma$ with a registration skew sensing mechanism and summing the initial angle of skew $\alpha$ and the registration angle of skew $\gamma$ so as to determine an absolute angle of skew $\delta$. The method additionally includes the step of driving the sheet differentially with the sheet driver to compensate for the absolute angle of skew $\delta$ so that the sheet is deskewed and one edge of the sheet is side registered.

Pursuant to another object of the present invention, there is provided an apparatus for deskewing and side registering a sheet having an unknown magnitude of side-to-side misregistration $\beta$ and an unknown initial angle of skew $\alpha$. The apparatus includes a selectably controllable drive mechanism for driving the sheet in a process direction D. The apparatus further includes a control mechanism for selectably controlling the drive mechanism to drive the sheet either differentially or non-differentially, the control mechanism controlling the drive mechanism to drive the sheet differentially to compensate for the magnitude of side-to-side misregistration $\beta$ and thereby induce a registration angle of skew $\gamma$, and further, to drive the sheet differentially to compensate for an absolute angle of skew $\delta$ which is defined by the sum of the initial angle of skew $\alpha$ and the registration angle of skew $\gamma$. Moreover, the apparatus includes an initial skew sensing mechanism for measuring the initial angle of skew $\alpha$ and a registration skew sensing mechanism for measuring the registration angle of skew $\gamma$. Additionally, the apparatus includes a mechanism for summing the initial angle of skew $\alpha$ and the registration angle of skew $\gamma$ so as to determine the absolute angle of skew $\delta$.

Other features of the present invention will become apparent as the following description proceeds and upon reference to the drawings, in which.

While the present invention will hereinafter be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

Figure 1:
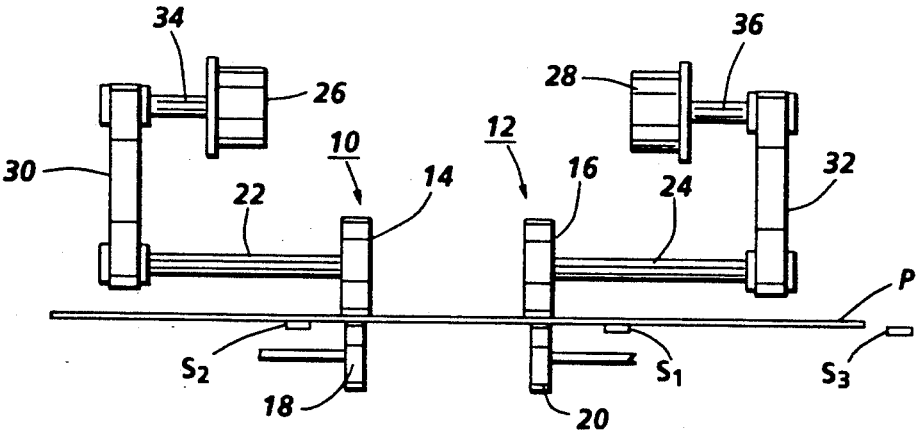
FIG. 1 is a schematic front elevational view showing a deskewing and side registration arrangement in accordance with the present invention.
Figure 2:
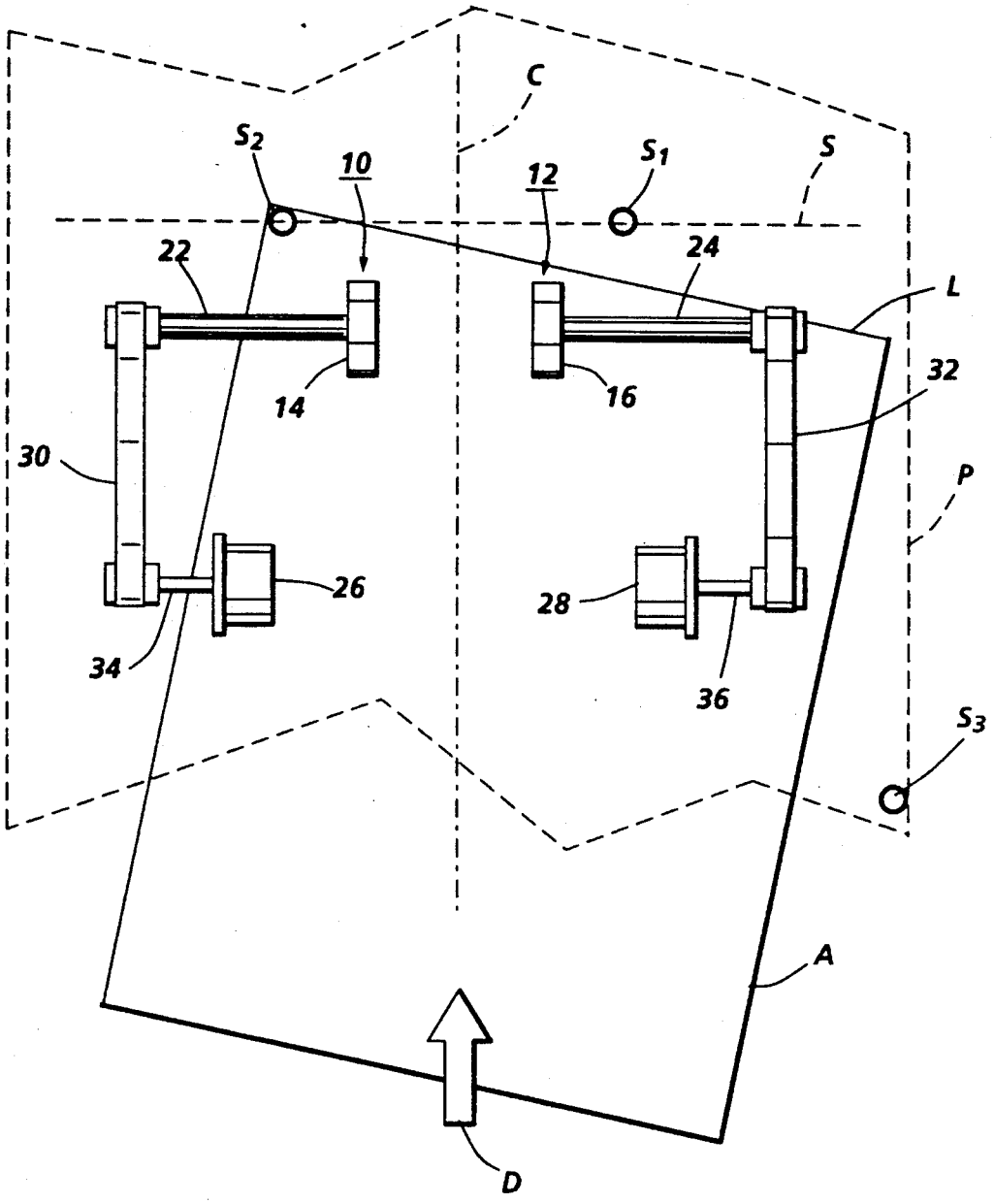
FIG. 2 is a schematic top elevational view of the deskewing and side registration arrangement of FIG. 1, and further showing the associated sheet path.

Referring now to the drawings, FIGS. 1 and 2 show an arrangement incorporating the present invention. It will be appreciated that the present invention finds advantageous use in any application where discrete sheets of material must be registered and/or deskewed, for example, a recirculating document handler handling original documents, a reproduction processor handling paper copy sheets or other final support surface, or any printing, copying, or document handling applications where the registration of such a discrete sheet is important. For purposes of description, the handling of copy sheets in a reproduction processor will be described.

A sheet of support material A, such as plain paper amongst others, is advanced along a sheet path P in a process direction D. Sheet A is passed into a pair of nip roll pairs 10 and 12. Nip roll pair 10 includes a drive roller 14 and an idler roller 18 while nip roll pair 12 includes a drive roller 16 and an idler roller 20. Each of the nip roll pairs frictionally engage sheet A therebetween. The drive rollers and the idler rollers are generally provided with a rubber or plastic surface suitable for substantial non-slipping engagement of sheets passed therebetween. Drive roller 14 is supported for controlled rotation on a roller shaft 22 while drive roller 16 is supported for controlled rotation on a roller shaft 24. Roller shaft 22 is drivingly engaged at one of its ends to an independently controllable drive motor 26 via a timing belt 30 and a motor shaft 34. Roller shaft 24 is drivingly engaged at one of its ends to another independently controllable drive motor 28 via another timing belt 32 and another motor shaft 36. Motors 26 and 28 are generally similar in construction and operational characteristics, and may comprise stepper motors. One suitable stepper motor is a Sigma Corporation, Series 20 stepper motor having a resolution of 200 step/rev.

Sheet path P is provided with three sensors $S_1$, $S_2$ and $S_3$. As shown in FIGS. 1 and 2, sensors $S_1$ and $S_2$ are spaced apart on a line S which is substantially perpendicular to the path of travel of sheet A along path P. Moreover, sensors $S_1$ and $S_2$ are positioned slightly downstream from nip roll pairs 10 and 12, and each such sensor is spaced approximately equidistant from a sheet path centerline C. Sensor $S_3$ is located at a position upstream from sensors $S_1$ and $S_2$ where one side edge of sheet A will pass, for detection by such sensor as shown in FIGS. 1 and 2 (see also FIG. 5). Sensors $S_1$, $S_2$ and $S_3$ may comprise reflective optical sensors which will produce an electrical signal upon occlusion by paper sheets or the like.

As sheet A enters the deskewing and side registering arrangement and is advanced through nip roll pairs 10 and 12, a lead edge portion L of sheet A occludes sensors $S_1$ and $S_2$. The exact sensor which is occluded first (i.e. either $S_1$ or $S_2$) depends on the direction of skew of the sheet, and it is entirely possible that the sheet will occlude both sensors $S_1$ and $S_2$ substantially simultaneously thereby indicating no skew in the sheet. In either event, upon occlusion, the sensors transmit an electrical signal to a control system 50 (see FIG. 3).

Control system 50 controls the operations of the reproduction machine, or a portion thereof, as is well known in the art of reproduction machine control, and may include a microprocessor capable of executing control instruction in accordance with a predetermined sequence, and subject to sensed parameters, and producing a controlling output in response thereto. Control system 50 may comprise a controller (not shown) which includes a memory. The controller may be similar to the controller disclosed in U.S. Pat. No. 4,475,156 to Federico et al. or the controller disclosed in U.S. Pat. No. 4,971,304 to Lofthus. The disclosures of both of the above U.S. Patents are hereby incorporated by reference in their entirety.

Figure 3:
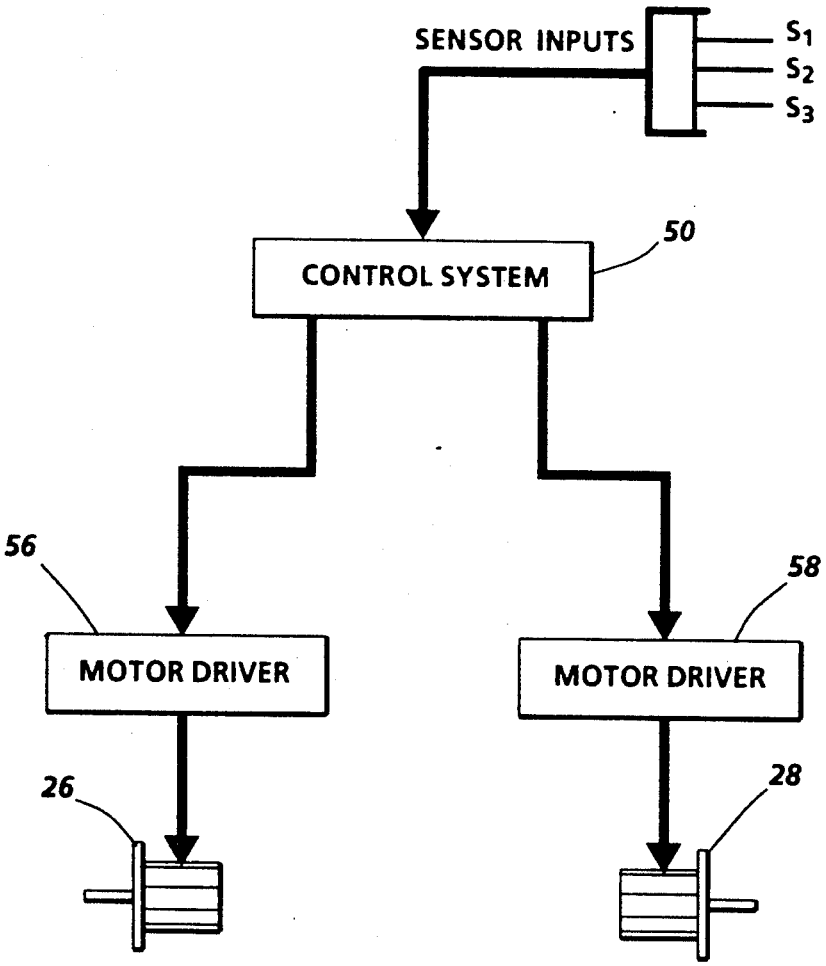
FIG. 3 shows the control arrangement for the deskewing and side registration arrangement of FIG. 1.

Sensors $S_1$, $S_2$ and $S_3$ provide sensing information in the form of electrical signals to control system 50 as shown in FIG. 3. With the above sensing information, the control system functions to control the operation of drive rollers 14 and 16. In particular, control system 50 drives a pair of motor driver boards 56 and 58. Motor drive board 56 provides pulses to motor 26 in accordance with the required movement and rotation velocity of drive roller 14 while motor drive board 58 provides pulses to motor 28 in accordance with the required movement and rotation velocity of drive roller 16. Motors 26 and 28 may be driven in a halfstep mode, although full step or microstep modes of operation could be used. The motor revolutions can thus be divided into a large number of halfsteps, each halfstep providing an exact increment of rotation movement of the motor shafts 34 and 36, and thus drive rollers 14 and 16. In accordance with this scheme, motor driver boards 56 and 58 respectively provide a pulse train to incrementally drive the motors 26 and 28.

It will be appreciated that the term "driving the sheet differentially" as used herein means that drive roller 14 is driven at a different rotation velocity than drive roller 16 thereby causing the sheet to be rotated within path P. Similarly, it will also be appreciated that the term "driving the sheet non-differentially" as used herein means that drive roller 14 is driven at substantially the same rotation velocity as drive roller 16 thereby causing the sheet to be advanced without rotation within path P. Further discussion of the meaning of the above two terms may be found in U.S. Pat. No. 4,971,304 to Lofthus which uses similar terms in a manner consistent with this description.

Figure 4:
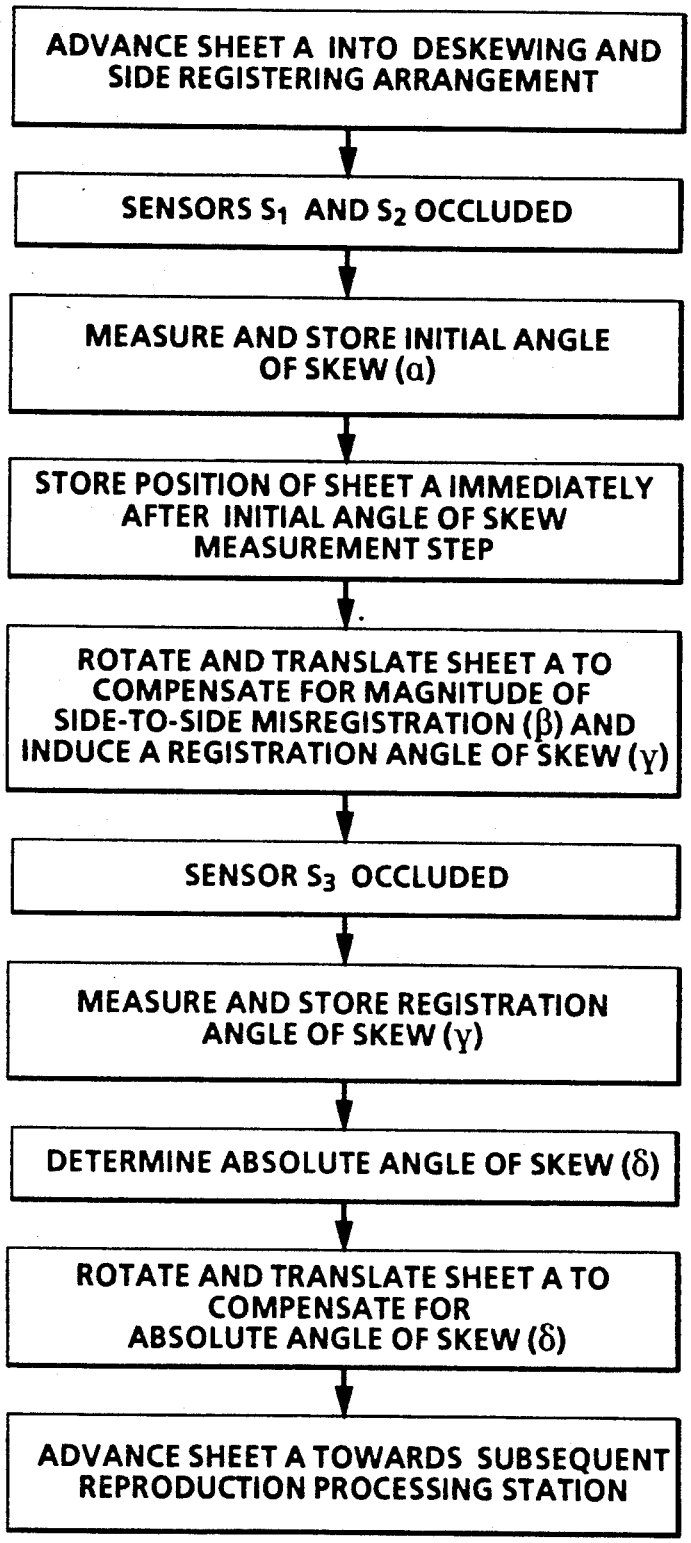
FIG. 4 is a flow chart showing the chain of operations of the present invention.
Figure 5:
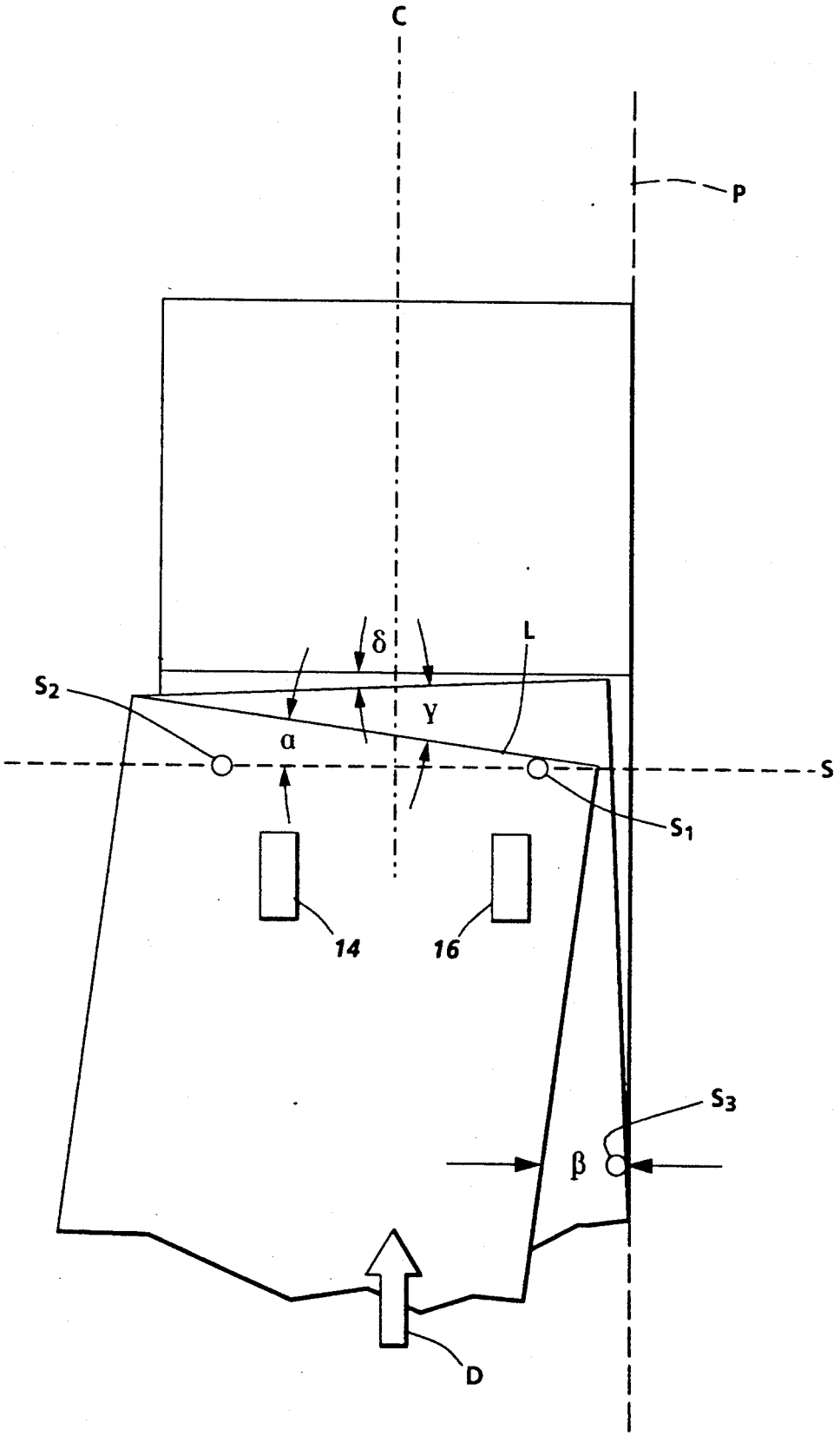
FIG. 5 depicts the movement of the sheet through the deskewing and side registration arrangement of FIG. 1.

The deskew and side registration apparatus operates in accordance with the flow chart of FIG. 4. Also, sheet A is shown in FIG. 5 at various positions relative to sensors $S_1$, $S_2$ and $S_3$ in path P during travel thereof in the process direction D. In operation, sheet A having an unknown magnitude of side-to-side misregistration $\beta$ and an unknown initial angle of skew $\alpha$ is driven non-differentially to enter the deskewing and side registering apparatus. The unknown initial angle of skew $\alpha$ is measured and stored in the memory of control system 50. The above measurement of the initial angle of skew may be performed in a manner similar to that disclosed in U.S. Pat. No. 4,971,304 to Lofthus which includes counting motor halfsteps between the occlusion of sensor $S_1$ and sensor $S_2$. Then, the position of sheet A, immediately after the initial angle of skew measurement step, is stored in the memory of the control system. Thereafter, sheet A is driven differentially to rotate and translate the sheet along path P until a side edge thereof occludes sensor $S_3$ thereby compensating for the magnitude of side-to-side misregistration $\beta$ and inducing a registration angle of skew $\gamma$. The registration angle of skew $\gamma$ is measured and stored in the memory of the control system. The registration angle of skew measurement may include maintaining one of the drive rollers stationary while rotating the other drive roller thereby rotating and translating sheet A until occlusion of sensor $S_3$ occurs, and counting motor halfsteps of the motor which drives the rotating drive roller between the position of sheet A immediately after the initial angle of skew measurement step and the occlusion of sensor $S_3$. Thereafter, the control system determines an absolute angle of skew $\delta$ by summing the stored initial angle of skew $\alpha$ and the stored registration angle of skew $\gamma$. Sheet A is then further driven differentially to rotate and translate the sheet along path P to remove the absolute angle of skew $\delta$ so that the sheet is deskewed and one edge of the sheet is side registered as shown in FIG. 5. Thereafter, the sheet is driven non-differentially in path P towards a subsequent reproduction processing station such as a transfer station wherein a latent image developed on a photoreceptor may be transferred to the sheet.

While the invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and scope of the appended claims.

I claim:

1. A method of deskewing and side registering a sheet comprising the steps of:

driving a sheet non-differentially in a process direction with a sheet driver, the sheet having an unknown magnitude of side-to-side misregistration and an unknown initial angle of skew;

measuring the initial angle of skew with an initial skew sensing means;

driving the sheet differentially with the sheet driver to compensate for the magnitude of side-to-side misregistration and thereby induce a registration angle of skew;

measuring the registration angle of skew with a registration skew sensing means;

summing the initial angle of skew and the registration angle of skew so as to determine an absolute angle of skew; and driving the sheet differentially with the sheet driver to compensate for the absolute angle of skew so that the sheet is deskewed and one edge of the sheet is side registered.

2. The method of claim 1, wherein said step of summing the initial angle of skew and the registration angle of skew so as to determine an absolute angle of skew comprises the steps of:

storing the initial angle of skew; and storing the registration angle of skew.

3. The method of claim 1, further comprising the step of continuing driving the sheet non-differentially in the process direction, wherein said continuing driving step is performed after the sheet is deskewed and one edge of the sheet is side registered.

4. The method of claim 1, wherein said step of measuring the initial angle of skew comprises the steps of:

sensing the leading edge of the sheet at a first location with a first sheet sensor;

sensing the leading edge of the sheet at a second location with a second sheet sensor;

determining the distance of travel of the sheet between the sensing of the leading edge of the sheet at the first location and the sensing of the leading edge of the sheet at the second location; and determining the initial angle of skew from said distance of travel.

5. An apparatus for deskewing and side registering a sheet having an unknown magnitude of side-to-side misregistration and an unknown initial angle of skew comprising:

selectably controllable drive means for driving the sheet in a process direction;

control means for selectably controlling said drive means to drive the sheet either differentially or non-differentially, said control means controlling said drive means to drive the sheet differentially to compensate for the magnitude of side-to-side misregistration and thereby induce a registration angle of skew, and further, to drive the sheet differentially to compensate for an absolute angle of skew which is defined by the sum of the initial angle of skew and the registration angle of skew;

initial skew sensing means for measuring the initial angle of skew;

registration skew sensing means for measuring the registration angle of skew; and means for summing the initial angle of skew and the registration angle of skew so as to determine the absolute angle of skew.

6. The apparatus of claim 5, wherein said summing means comprises means for storing the initial angle of skew and the registration angle of skew.

7. The apparatus of claim 5, wherein said drive means comprises at least two independently controllable and spaced apart sheet drivers selectably controllable by said control means for driving the sheet differentially and non-differentially.

8. The apparatus of claim 7, wherein each sheet driver comprises a stepper motor for separately driving a frictional sheet feeder.

9. The apparatus of claim 5, wherein said initial skew sensing means comprises first and second sheet sensors for sequentially sensing a lead edge of the sheet.

10. The apparatus of claim 5, wherein said registration skew sensing means comprises a third sheet sensor for sensing a side edge of the sheet.

11. A method of registering a sheet comprising the steps of:

driving a sheet non-differentially in a process direction;

measuring an initial angle of skew of the sheet;

driving the sheet differentially to induce a registration angle of skew;

measuring the registration angle of skew of the sheet;

summing the initial angle of skew and the registration angle of skew to determine an absolute angle of skew of the sheet; and driving the sheet differentially to compensate for the absolute angle of skew so as to register one side edge of the sheet.

12. The method of claim 11, wherein the step of summing comprises the steps of:

storing the initial angle of skew; and storing the registration angle of skew.

13. The method of claim 11, further comprising the step of continuing driving the sheet non-differentially in the process direction, wherein said continuing driving step is performed after registering one side edge of the sheet.

14. The method of claim 11, wherein said step of measuring the initial angle of skew comprises the steps of:

sensing the leading edge of the sheet at a first location;

sensing the leading edge of the sheet at a second location;

calculating the distance of travel of the sheet between the sensing of the leading edge of the sheet at the first location and the sensing of the leading edge of the sheet at the second location; and determining the initial angle of skew as a function of the calculated travel.

15. An apparatus for registering a sheet comprising:

drive means for driving the sheet in a process direction;

control means for selectably controlling said drive means to drive the sheet either differentially or non-differentially, said control means controlling said drive means to drive the sheet differentially to induce a registration angle of skew;

means for measuring an initial angle of sheet skew;

means for measuring the registration angle of sheet skew; and means for summing the initial angle of sheet skew and the registration angle of sheet skew to determine an absolute angle of sheet skew, said control means driving the sheet differentially to compensate for the absolute angle of sheet skew.

16. The apparatus of claim 15, wherein said summing means comprises means for storing the initial angle of skew and the registration angle of skew.

17. The apparatus of claim 15, wherein said drive means comprises at least two independently controllable and spaced apart sheet drivers selectably controllable by said control means for driving the sheet differentially and non-differentially.

18. The apparatus of claim 17, wherein each sheet driver comprises a stepper motor for separately driving a frictional sheet feeder.

19. The apparatus of claim 15, wherein said initial skew measuring means comprises first and second sheet sensors for sequentially sensing a lead edge of the sheet.

20. The apparatus of claim 15, wherein said registration skew measuring means comprises a third sheet sensor for sensing a side edge of the sheet.

* * * * *